United States Patent [19]

Hart

[11] Patent Number: 4,935,632

[45] **Date of Patent: * Jun. 19, 1990**

[54] LUMINESCENT CONCENTRATOR LIGHT SOURCE

[75] Inventor: Douglas Hart, Toronto, Canada

[73] Assignee: Landus Inc., Campbellville, Canada

[ * ] Notice: The portion of the term of this patent subsequent to Nov. 29, 2005 has been disclaimed.

[21] Appl. No.: 271,436

[22] Filed: Nov. 15, 1988

Related U.S. Application Data

[63] Continuation-in-part of Ser. No. 910,537, Sep. 27, 1986, Pat. No. 4,788,437.

[30] Foreign Application Priority Data

Sep. 23, 1985 [GB] United Kingdom ..... 8523422

[51] Int. Cl.[5] ..... H01J 65/00; G21H 3/02

[52] U.S. Cl. ..... 250/486.1; 250/462.1; 250/487.1; 250/493.1; 250/503.1; 313/54

[58] Field of Search ..... 250/486.1, 483.1, 487.1, 250/462.1, 493.1, 503.1, 494.1; 313/54

[56] References Cited

U.S. PATENT DOCUMENTS

| | | | |
|---|---|---|---|
| 2,749,251 | 6/1956 | Shapiro | 250/487.1 |
| 3,238,139 | 3/1966 | Fischer et al. | 250/462.1 |
| 3,578,973 | 3/1969 | Dooley et al. | 250/462.1 |
| 4,488,047 | 12/1984 | Thomas | 250/486.1 |
| 4,677,008 | 6/1987 | Webb | 40/542 |
| 4,788,437 | 11/1988 | Urquhart et al. | 250/486.1 |
| 4,795,910 | 1/1989 | Henderson et al. | 250/483.1 |

*Primary Examiner*—Constantine Hannaher
*Attorney, Agent, or Firm*—Sim & McBurney

[57] ABSTRACT

A light assembly comprises a self-luminescent light source, a wave guide and output optics. The self-luminescent light source takes the form of a luminescent concentrator which is activated by beta radiation from tritium which is immobilized in a matrix in which a luminescent material is distributed.

14 Claims, 2 Drawing Sheets

LUMINESCENT CONCENTRATOR LIGHT SOURCE

REFERENCE TO RELATED APPLICATION

This application is a continuation-in-part of copending U.S. Patent application Ser. No. 910,537 filed Sept. 27, 1986 now U.S. Pat. No. 4,788.437.

FIELD OF INVENTION

The present invention relates to self-powered light sources and, in particular, to light sources activated by tritium bound in non-gaseous form.

BACKGROUND TO THE INVENTION

It is well known that radiation from beta, gamma and other radioactive sources is able to generate light when it strikes certain types of luminescent materials, such as phosphors. The most commonly-used of these radioactive sources is tritium, a weak beta particle emitter.

Conventional luminescent light sources use tritium gas inside a phosphor-coated glass envelope. Typical prior art applications of such light sources are in luminescent safety signs (see, e.g., U.S. Pat. No. 3,409,770), light standards (see, e.g., U.S. Pat. No. 3,889,124), dials and gauges requiring low level high reliability lighting.

A limitation to the extensive use of this technology is that high levels of light intensity are difficult to achieve, owing to the low level of phosphor emissions. Source brightness has remained at relatively low levels, in the range of about 100 to about 800 microlamberts.

In the prior art, concentration of the light has been attempted using reflectors mounted behind the glass tubes. However, this procedure provides no increase in the overall light intensity.

A further problem with the prior art structures is the vulnerability of the enclosure to fracture or breakage and the potential for release of radioactive material. Higher intensity light sources using the conventional structure would require higher levels of radioactivity, thereby increasing the radiation hazard upon fracture or breakage of the enclosure.

In view of these problems with gaseous tritium, attempts have been made to provide the tritium in a safer form by chemical immobilization. One specific prior art disclosure of such attempt in U.S. Pat. No. 2,749,251 discloses a self-luminescent material consisting of an inorganic phosphor intimately mixed with a tritium-containing compound, including a variety of organic compounds, such as alcohols and paraffinic acids. This intimate mixture is coated as a thin layer on the exterior of a light-reflecting surface. This reference does not describe any structure in which a luminescent concentrator is provided nor wherein the tritium is incorporated in a matrix.

Another prior art disclosure is U.S. Pat. No. 3,238,139 which describes a luminescent body consisting essentially of a solid mass of translucent tritium-containing synthetic resin having distributed therethrough particles of a luminous material. This reference, however, does not describe the provision of a luminescent concentrator, so the light produced is quite diffuse.

SUMMARY OF INVENTION

The present invention seeks to overcome these problems of the prior art to achieve higher source brightness and higher levels of safety.

In accordance with the present invention, there is provided a luminescent concentrator light source comprising a plurality of elements. Tritium is immobilized to a carrier therefor and is distributed in a matrix material. A luminescent material activatable to generate electromagnetic radiation, preferably visible light by beta radiation produced by the tritium also is distributed in the matrix material. An outer surface to the matrix material is formed of a material which enhances internal reflection of electromagnetic radiation produced by the luminescent material.

In the present invention, therefore, not only is tritium immobilized to a carrier and distributed in a matrix along with a luminescent material, thereby to generate light, but also the outer surface of the matrix enhances internal reflection of light, thereby intensifying the light energy.

A variety of geometric shapes for the luminescent concentrator may be employed, including flat plates, rods, cylinders and a variety of solid shapes, as desired for a specific end use.

GENERAL DESCRIPTION OF INVENTION

Figure 1:
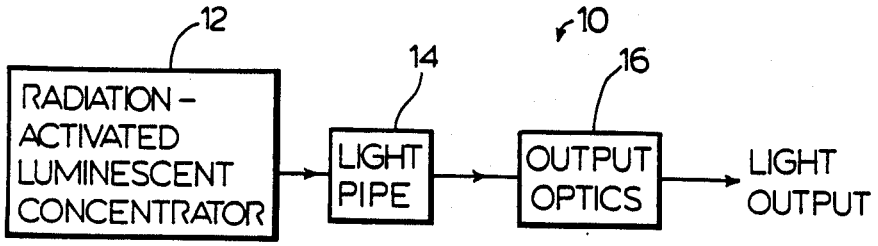
FIG. 1 illustrates, in block diagram form, a light assembly including a luminescent concentrator of the present invention.

The luminescent concentrator used herein may take a variety of forms, wherein the tritium is located internally of the luminescent concentrator. The tritium is immobilized to a carrier and is distributed in a matrix, which preferably takes the form of a solid polymeric material. The tritium preferably is immobilized by chemical binding of the tritium to the polymeric material. The tritium may be chemically bound into the concentrator matrix by any convenient procedure. For example, polymerizable monomer containing tritium may first be formed by conventional hydrogenation techniques employing tritium in place of hydrogen and the monomer then may be homopolymerized or copolymerized with another polymerizable monomer to form a solid matrix in which the tritium is chemically bound. The luminescent material may be incorporated into the monomer mix prior to polymerization.

Alternatively, the tritium may be immobilized by chemical bonding to a substance separate from the matrix material, which substance is distributed in the matrix material. While the matrix material preferably comprises a solid polymeric material for ease of construction and operation, the matrix also may comprise a liquid material in which the other components are dissolved or chemically-bound, and which is contained in a solid surrounding material.

Also distributed in the matrix material is a luminescent material, which may be a phosphor material, fluorescent dye or any other material which is activated to produce light by beta radiation. The luminescent material may be distributed as such in the matrix, (i.e., dissolved in the matrix) or may be chemically bound to a carrier, which preferably is the polymeric material of the matrix.

The beta-radiation from the immobilized tritium in the matrix excites the luminescent material in the matrix. An outer surface is provided to the matrix material to trap and internally reflect the light within the matrix so as to concentrate the light for emission from a desired location. The outer surface of the matrix material for this purpose may be formed of a material having a refractive index different from that of the remainder of the matrix material. Alternatively, the outer surface of the matrix material may have a coating of silver or similar highly-reflective material.

The luminescent concentrator light source of the invention may be provided in any desired shape, preferably an elongate cylindrical shape, from which light emanates from one or both ends. For a cylindrical shape, the output luminescence is proportional to the ratio of the volume of the matrix to the surface area of the end or ends from which light is emitted, ignoring absorption losses. In one particularly preferred embodiment, the light source takes the form of an optical fibre, or a bundle of such fibres.

Since the tritium is immobilized in the matrix, there is no need for a vacuum tight enclosure in this invention. In addition, the matrix may be formed into any desired configuration, to permit concentration of the light. A strong covalent linkage of the tritium to the matrix polymer also enhances the safety of the light source since the tritiated material would not be dangerous if the device is broken, but rather remains chemically bound to its host material. In addition, decay of the tritium produces harmless helium gas, which can easily permeate and escape the matrix in the form of a gas.

An additional benefit of this invention lies in the fact that tritium gas may have attraction for vandals and terrorists, since it is an important component in the construction of nuclear weapons. By immobilizing the tritium, preferably by covalently binding the tritium into a solid matrix as described above, the tritium is no longer in the form of a gas, but rather is diluted by the presence of many chemically-identical hydrogen atoms. The problem of isotope separation of the tritium from this mixture is a formidable one, requiring a huge capital investment in equipment, almost equivalent to the costs to produce tritium itself.

The luminescent concentrator of the invention may be combined in any convenient manner into an overall light assembly. In one preferred aspect of the invention, the luminescent concentrator comprises the light generating element of a three-component assembly which also includes a light guide and a light output assembly. The light emitted from the desired exit location on the luminescent concentrator enters one end of the light guide, which may take the form of a solid or hollow light pipe or fibre-optic bundle, through which it is transmitted to the output optics. In this assembly, the light generator is separated from the output optics, so that tritium gas or other appropriate radioactive material can be contained and protected within a strong and secure enclosure. Further, by separating the light generator from the output optics, it is possible to locate the light source in a position less vulnerable to abuse or accidental fracture. Fracture of the light guide or destruction of the output optical assembly does not lead to the escape of radioactive material, since it remains housed in its enclosure.

A three-component assembly of a light source, a light guide and output optics is not itself novel having regard to the disclosure of U.S. Pat. No. 3,578,973. However, the latter patent does not describe or suggest the utilization of an immobilized tritium-activated luminescent concentrator as part of the light source.

Although the disclosure refers specifically to the generation and emission of visible light, the structures described herein and the principles thereof are not limited thereto but may also be configured to emit in any range of the electromagnetic spectrum, including infrared, microwave and radio frequencies, depending on the materials employed. Similarly, radioactive source materials other than tritium may be employed, although the latter is preferred in view of the low levels of radiation involved, the ready availability of tritium, the availability of materials excitable by the radiation emitted therefrom and the harmless and inert nature of the radiation decay product, which is helium.

DESCRIPTION OF PREFERRED EMBODIMENT

Referring to the drawings, FIG. 1 illustrates a three-component light assembly 10 comprising a luminescent concentrator 12, a light pipe 14 and output optics 16. The luminescent concentrator 12 is radiation activated by tritium. Light emanates from the concentrator 12 to the light pipe 14 and thence to the external light output optical assembly 16.

The visual acquisition of a light from a distance depends on its brightness, size and colour. In the present invention, all three can be manipulated by the choice of materials and concentration, as discussed in more detail below. Since the light is transmitted from the concentrator 12 to the optical output 16 by a light guide 14, which may be in the form of a fibre-optic bundle, an electro-optic or mechanical switch, activated by a suitable signal, may be introduced at any convenient location to selectively interrupt light transmission, and thereby switch the light on and off. The prior art tritium lights cannot be switched on and off.

Figure 2:
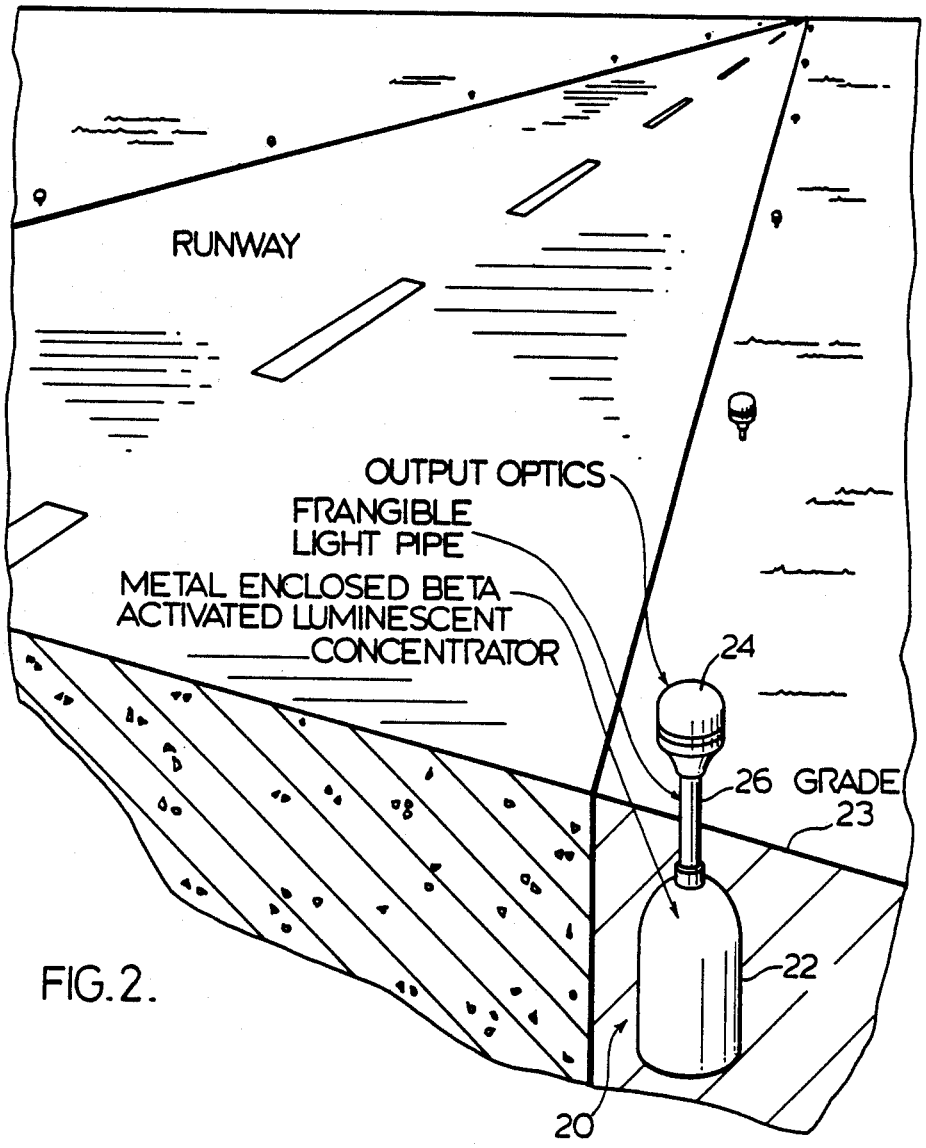
FIG. 2 is a schematic representation of the light assembly of FIG. 1 in the form of runway marker lights.

FIG. 2 illustrates the application of the three-component light assembly of FIG. 1 to a self-activated runway marker light 20, which is representative of a number of similar applications of the luminescent concentrator of the invention. A metal-enclosed light generator 22, corresponding to the tritium-activated luminescent concentrator 12, is buried below the grade and is connected to a light-output optical assembly 24 corresponding to the output optics 16 by a frangible light pipe 26 which may be of any convenient length and which corresponds to the light pipe 14.

The light assembly 20 provides a continuous safe light emission. In the event of accidental impact on the light, the frangible light pipe 26 fractures and breaks away. The metal-encased radioactive source, however, remains unaffected and intact. A replacement light pipe and optical assembly readily may be attached to the salvaged light generator to restore the light for service.

Figure 3:
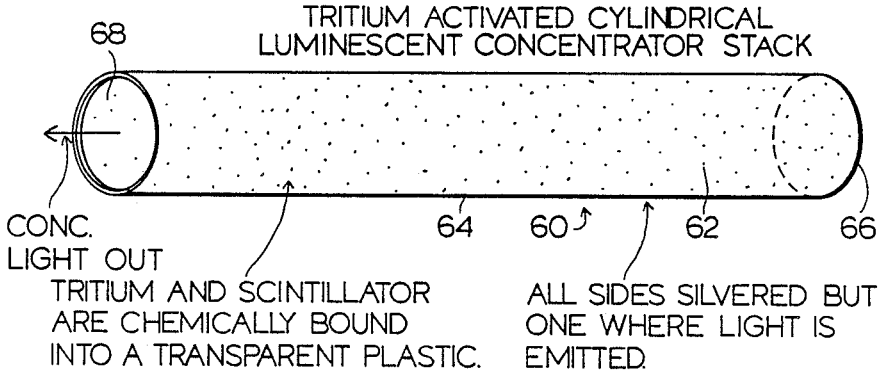
FIG. 3 is a perspective view of a luminescent concentrator provided in accordance with one embodiment of the present invention.

One specific embodiment of luminescent concentrator provided in accordance with the present invention and useful in the structures of FIGS. 1 and 2, is illustrated in FIG. 3 described below.

Referring to FIG. 3, a light source 60 comprises a tubular body 62, which is a matrix of transparent polymeric material in which tritium is chemically bound and in which the luminescent material is distributed. The beta radiation from the chemically-bound tritium excites the luminescent material to emit light, which then is reflected internally of the tube 62 towards the ends. The outer surface 64 and one end 66 are coated with highly reflective material, such as silver, to enhance internal reflection and to ensure that light is not lost therethrough. Light emission from the luminescent concentrator 60 then occurs through the non-coated end 68.

SUMMARY OF DISCLOSURE

In summary of this disclosure, the present invention provides a novel light source based on radioactivity-generated luminescence by providing for, concentration of the luminescence. Modifications are possible within the scope of this invention.

What is claim is:

1. A luminescent concentrator light source, comprising:

a matrix material, tritium immobilized to a carrier therefor and being distributed in said matrix material, a luminescent material activatable to generate electromagnetic radiation by beta radiation produced by said tritium and being distributed in said matrix material by being dissolved therein or immobilized to a carrier therefor, and an outer surface to said matrix material formed of a material which enhances internal reflection of electromagnetic radiation produced by said luminescent material.

2. The light source of claim 1, wherein said matrix material is a solid polymeric material.

3. The light source of claim 2, wherein said tritium is immobilized to a carrier therefor by chemically-binding said tritium to said polymeric material.

4. The light source of claim 3, in the form of an elongate cylindrical structure.

5. The light source of claim 4 wherein said elongate cylindrical structure comprises an optical fibre material.

6. The light source of claim 1, wherein said matrix material is a liquid material which is contained within a solid surrounding material.

7. The light source of claim 6, wherein said tritium is immobilized to a carrier therefor by chemically-binding said tritium to said liquid material.

8. The light source of claim 1 wherein said outer surface of said matrix material is formed of a material having a refractive index different from that of the remainder of the matrix material.

9. The light source of claim 1 wherein said outer surface of said matrix material bears a silver coating to effect such reflection.

10. The light source of claim 1 wherein said matrix material is a polymeric material and constitutes said carrier for said luminescent material, which is chemically bound thereto.

11. The light source of claim 10 wherein said polymer is a solid polymeric material or a liquid polymeric material which is contained within a solid surrounding material.

12. The light source of claim 1, in combination with:

light guide means for guiding light from said source to a remote location, and light emitter means at said remote location for emitting light received from said light source through said guide means.

13. The combination of claim 12 including means for selectively preventing light from passing from said source to said emitter means, wherein light emission from said light source is turned on and off.

14. A luminescent concentrator light source, comprising:

a matrix material which is a transparent solid polymeric material, tritium chemically bound to said matrix material, a luminescent material activatable to generate electromagnetic radiation by beta radiation produced by said tritium and chemically bound to said matrix material, whereby said tritium and said luminescent material are distributed in said matrix material and are molecularly intermixed, and an outer surface of said matrix material formed of a material which enhances internal reflection of electromagnetic radiation produced by said luminescent material.

* * * * *